US010500115B2

(12) United States Patent
Weedling

(10) Patent No.: US 10,500,115 B2
(45) Date of Patent: Dec. 10, 2019

(54) PATIENT TRANSFER DEVICE HAVING INFLATABLE AIR MATTRESS AND FIXEDLY-ATTACHED SLING SHEET

(71) Applicant: AIRPAL INC., Coopersburg, PA (US)

(72) Inventor: James E. Weedling, Center Valley, PA (US)

(73) Assignee: Airpal, Inc., Coopersburg, PA (US)

( * ) Notice: Subject to any disclaimer, the term of this patent is extended or adjusted under 35 U.S.C. 154(b) by 563 days.

(21) Appl. No.: 14/898,921

(22) PCT Filed: May 22, 2015

(86) PCT No.: PCT/US2015/032151

§ 371 (c)(1),
(2) Date: Dec. 16, 2015

(87) PCT Pub. No.: WO2015/179748

PCT Pub. Date: Nov. 26, 2015

(65) Prior Publication Data

US 2016/0367422 A1 Dec. 22, 2016

Related U.S. Application Data

(60) Provisional application No. 62/002,465, filed on May 23, 2014.

(51) Int. Cl.
*A61G 7/10* (2006.01)

(52) U.S. Cl.
CPC ..... *A61G 7/1021* (2013.01); *A61G 7/1023* (2013.01); *A61G 7/1026* (2013.01)

(58) Field of Classification Search
CPC .. A61G 7/1021; A61G 7/1023; A61G 7/1026; A61G 7/1028; A61G 7/1025; A47C 27/08–10
See application file for complete search history.

(56) References Cited

U.S. PATENT DOCUMENTS 3,829,914 A * 8/1974 Treat ..... A47C 21/00 5/495
4,528,704 A * 7/1985 Wegener ..... B65G 7/06 180/125
4,809,375 A * 3/1989 Bull ..... A47C 21/048 5/722
5,442,821 A 8/1995 Weeks
6,954,957 B2 * 10/2005 Metzger ..... A47C 27/081 5/498
7,739,758 B2 * 6/2010 Weedling ..... A61G 7/103 5/81.1 HS
8,234,727 B2 8/2012 Schreiber et al.
(Continued)

OTHER PUBLICATIONS

Korean Patent Office, International Search Report and the Written Opinion of the International Searching Authority, dated Sep. 1, 2015, for PCT/US2015/032151.

*Primary Examiner* — Eric J Kurilla
(74) *Attorney, Agent, or Firm* — Design IP

(57) ABSTRACT

In one respect, the invention of the present application is a patient transfer device having an inflatable air mattress and a fixedly-attached sling sheet. In another respect, the invention is a method of indexing an inflatable air mattress and a sling sheet together before fixedly joining them together in order to create an improved patient transfer device.

19 Claims, 12 Drawing Sheets

(56) References Cited

U.S. PATENT DOCUMENTS

| | | | | |
|---|---|---|---|---|
| 2006/0195985 | A1* | 9/2006 | Keith | A41D 27/24 5/502 |
| 2009/0106893 | A1 | 4/2009 | Blevins | |
| 2014/0041114 | A1 | 2/2014 | Davis | |
| 2015/0047121 | A1* | 2/2015 | Berg | A61G 7/1051 5/83.1 |

* cited by examiner

PATIENT TRANSFER DEVICE HAVING INFLATABLE AIR MATTRESS AND FIXEDLY-ATTACHED SLING SHEET

FIELD OF THE INVENTION

The present invention relates to patient transfer devices comprising an inflatable mattress, more particularly to a patient transfer device comprising an inflatable air mattress with a sling sheet fixedly attached thereto.

BACKGROUND

It is known to place and temporarily leave a patient transfer device between a patient and a hospital or other bed, the patient transfer device comprising an inflatable/deflatable mattress that may be periodically inflated in order to assist with the movement or repositioning of the patient. These patient transfer devices are sometimes used with separate sling sheets, which are also temporarily left underneath the patient and used to move and reposition patients, sometimes with the assistance of robotic cranes or lifts. Because the sling sheets are separate from the patient transfer devices, the sling sheets have a tendency to bunch underneath the patient, thereby causing discomfort and bed sores. This arrangement also makes the individual parts more difficult and expensive to store, sort, and launder.

Accordingly, there is a need for an improved patient transfer device that overcomes these and other problems present in the prior art.

BRIEF DESCRIPTION OF THE DRAWINGS

The patient transfer device having an inflatable air mattress and fixedly-attached sling sheet according to the present invention is further described with reference to the accompanying drawings, in which.

ADDITIONAL ASPECTS OF THE INVENTION

Figure 1:
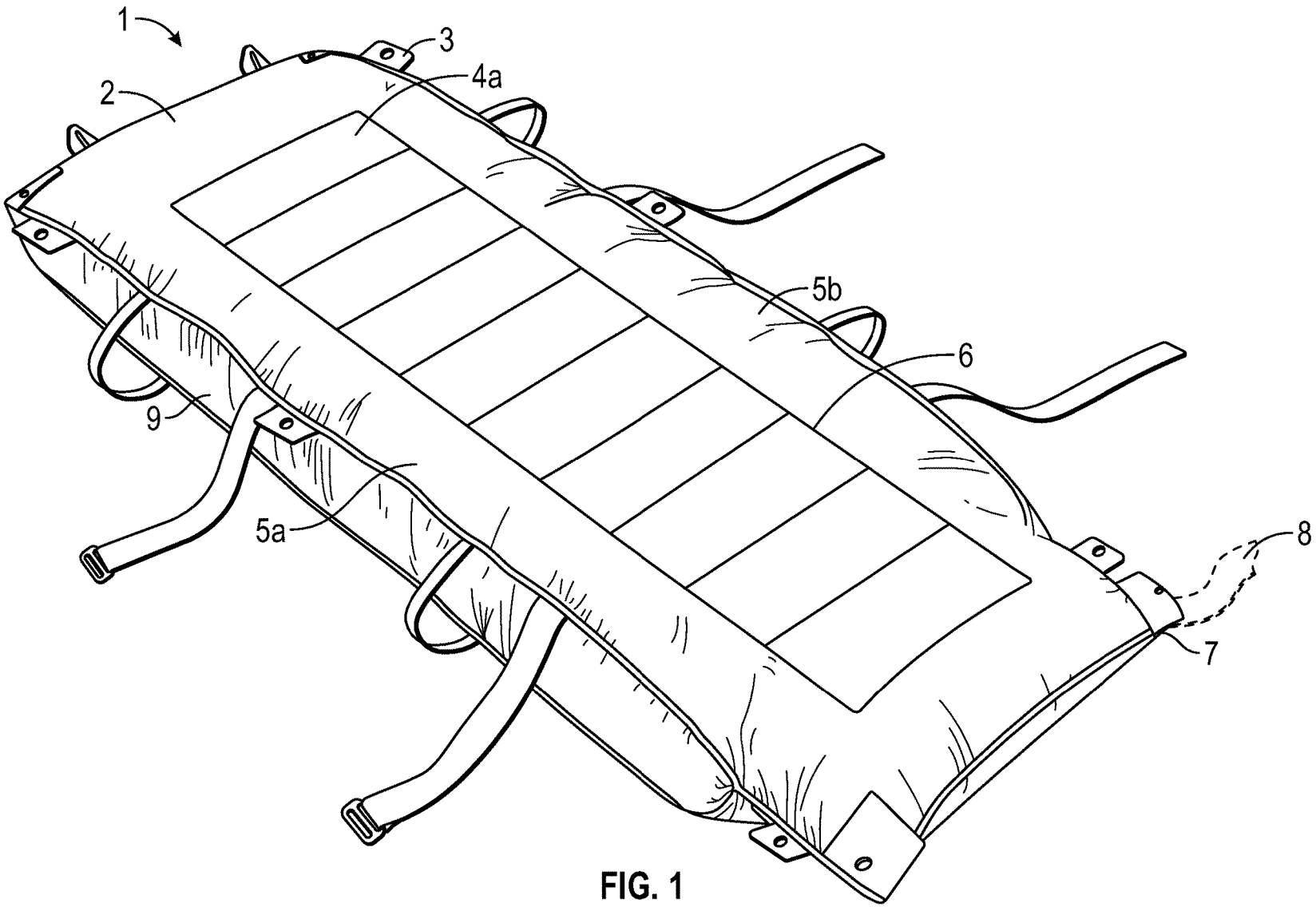
FIG. 1 (Prior Art)
FIG. 1 is a front perspective view of a prior art patient transfer device having an inflatable mattress.
Figure 2:
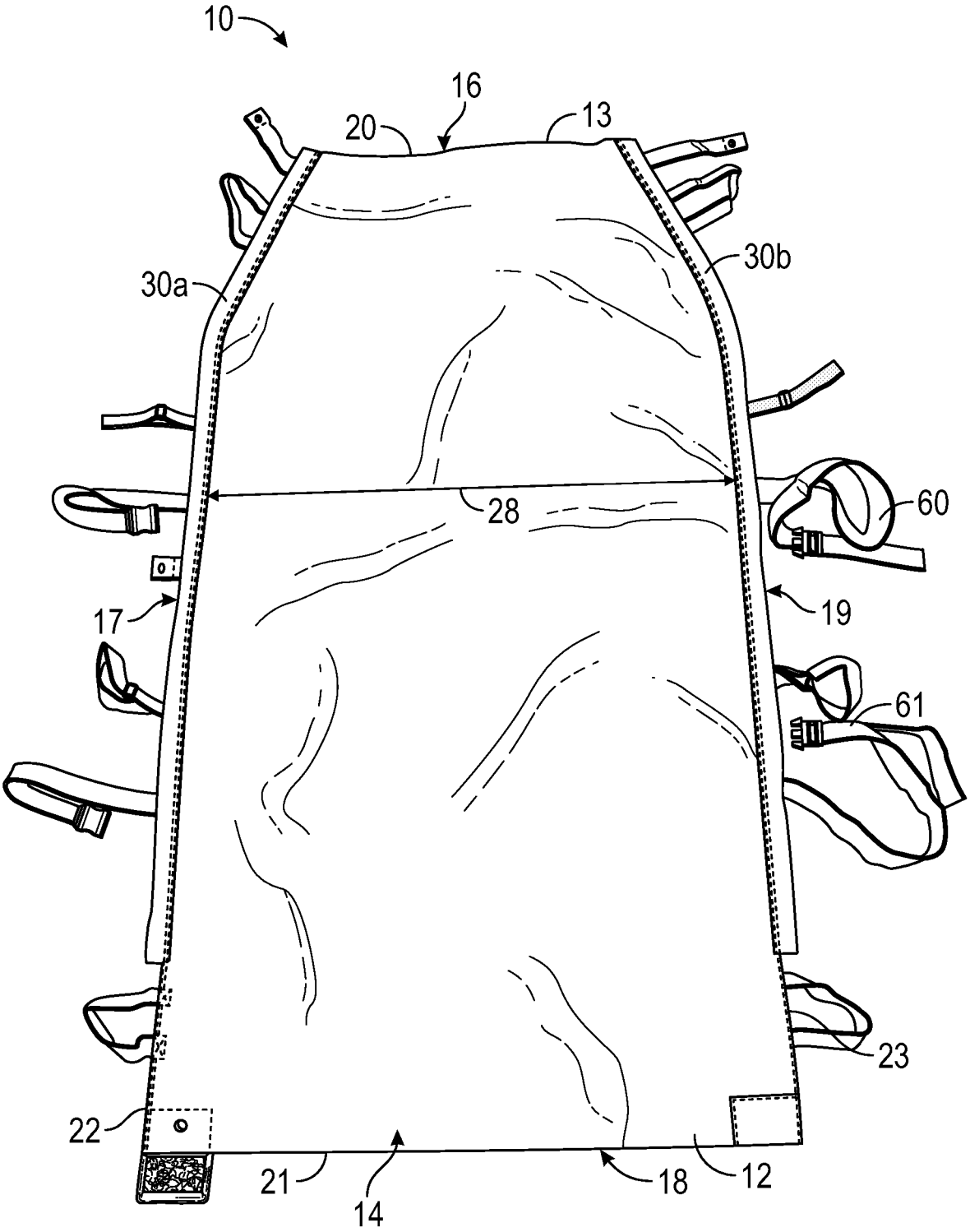
FIG. 2 is a front, elevated perspective view of a patient transfer device having an inflatable mattress in accordance with the present invention, with the fixedly-attached sling sheet omitted from view for ease of discussion.

Additional aspects of the invention include:

Aspect 1: A patient transfer device comprising: an inflatable mattress having a top panel, the top panel having a top edge, a bottom edge, a first side edge, and a second side edge, the top edge, bottom edge, and first and second side edges collectively forming a perimeter of the top panel of the inflatable mattress; a sling sheet having a top panel portion, the top panel portion having a first side and a second side; a first reinforcement strip that is fixedly attached to the first side edge of the top panel of the inflatable mattress and to the first side of the top panel portion of the sling sheet; and a second reinforcement strip that is fixedly attached to the second side edge of the top panel of the inflatable mattress and to the second side of the top panel portion of the sling sheet.

Aspect 2: The patient transfer device of Aspect 1, wherein the first reinforcement strip and the second reinforcement strip are fixedly attached between the top panel of the inflatable mattress and the top panel portion of the sling sheet.

Aspect 3: The patient transfer device of either of Aspect 1 and Aspect 2, wherein the first reinforcement strip and second reinforcement strip are fixedly attached to the inflatable mattress and to the sling sheet via sewn threads.

Aspect 4: The patient transfer device of any of Aspects 1-3, wherein at least a portion of the first reinforcement strip and at least a portion of the second reinforcement strip extend outside of the perimeter of the top panel of the inflatable mattress.

Aspect 5: The patient transfer device of any of Aspects 1-4, wherein the mattress has a longitudinal length measured along the first side edge of the top panel between the top edge and the bottom edge thereof, the first reinforcement strip has a top end, a bottom end, and a longitudinal length measured along the first side edge of the top panel between the top end and the bottom end of the first reinforcement strip, and the longitudinal length of the first reinforcement strip is at least 50% of the longitudinal length of the mattress.

Aspect 6: The patient transfer device of Aspect 5, wherein the longitudinal length of the first reinforcement strip is at least 80% of the longitudinal length of the mattress.

Aspect 7: The patient transfer device of Aspect 5, wherein at least a portion of the first reinforcement strip extends outside of the perimeter of the top panel of the inflatable mattress.

Aspect 8: The patient transfer device of any of Aspects 1-7, further comprising a first carrying strap that is fixedly attached to the first reinforcement strip and a second carrying strap that is fixedly attached to the second reinforcement strip.

Aspect 9: A method of constructing a patient transfer device, the patient transfer device comprising an inflatable mattress having a width and a sling sheet having a width, the method comprising: placing the sling sheet adjacent to the inflatable mattress; applying a sufficient amount of tension along the width of the inflatable mattress while it is uninflated to remove all folds and wrinkles from the width of the inflatable mattress while applying a sufficient amount of tension along the width of the sling sheet to remove all folds and wrinkles from the width of the sling sheet; and fixedly attaching together the inflatable mattress and the sling sheet so that the width of the inflatable mattress and the width of the sling sheet are indexed together.

Aspect 10: The method of Aspect 9, further comprising the step of fixedly attaching at least one reinforcement strip between the inflatable mattress and the sling sheet.

Aspect 11: The method of either of Aspect 9 and Aspect 10, further comprising fixedly attaching at least one carrying strap to the at least one reinforcement strip.

Aspect 12: The method of any of Aspects 9-11, wherein the step of fixedly attaching together the inflatable mattress and the sling sheet further comprises sewing the inflatable mattress and the sling sheet together.

Aspect 13: A patient transfer device comprising: an inflatable mattress having a top panel, a bottom panel, a first side, a second side, a first gusset attached between the top panel and the bottom panel along at least a portion of the first side, and a second gusset attached between the top panel and the bottom panel along at least a portion of the second side, the top panel having a first side edge corresponding with the first side of the inflatable mattress and a second side edge corresponding with the second side of the inflatable mattress; a sling sheet having a top panel portion, the top panel portion having a first side and a second side; a first reinforcement strip that is fixedly attached to the first side edge of the top panel of the inflatable mattress and the first side of the top panel portion of the sling sheet; a second reinforcement strip that is fixedly attached to the second side edge of the top panel of the inflatable mattress and the second side of the top panel portion of the sling sheet; a first carrying strap that is fixedly attached to the first reinforcement strip; and a second carrying strap that is fixedly attached to the second reinforcement strip.

Aspect 14: The patient transfer device of Aspect 13, wherein the first gusset has a longitudinal length measured along the first side of the inflatable mattress, the second gusset has a longitudinal length measured along the second side of the inflatable mattress, the first reinforcement strip has a top end, a bottom end, and a longitudinal length measured along the first side edge of the top panel between the top end and the bottom end of the first reinforcement strip, the second reinforcement strip has a top end, a bottom end, and a longitudinal length measured along the second side edge of the top panel between the top end and the bottom end of the second reinforcement strip, wherein the longitudinal length of the first reinforcement strip is greater than the longitudinal length of the first gusset and the longitudinal length of the second reinforcement strip is greater than the longitudinal length of the second gusset.

Aspect 15: The patient transfer device of either of Aspect 13 and Aspect 14, wherein the top panel of the inflatable mattress further comprises a top edge and a bottom edge, the top edge, bottom edge, and first and second side edges of the top panel collectively forming a perimeter of the top panel, wherein at least a portion of the first reinforcement strip and at least a portion of the second reinforcement strip extend outside of the perimeter of the top panel.

Aspect 16: The patient transfer device of any of Aspects 13-15, wherein the first reinforcement strip and the second reinforcement strip are fixedly attached between the top panel of the inflatable mattress and the top panel portion of the sling sheet.

Aspect 17: The patient transfer device of any of Aspects 13-16, wherein the first reinforcement strip and second reinforcement strip are fixedly attached to the inflatable mattress and to the sling sheet via sewn threads.

Aspect 18: The patient transfer device of any of Aspects 13-17, wherein the top panel of the inflatable mattress further comprises a top edge and a bottom edge, the top edge, bottom edge, and first and second side edges of the top panel of the inflatable mattress collectively forming a perimeter of the top panel, wherein at least a portion of the first reinforcement strip and at least a portion of the second reinforcement strip extend outside of the perimeter of the top panel of the inflatable mattress.

Aspect 19: A patient transfer device comprising: an inflatable mattress having a top panel, the top panel having a top edge, a bottom edge, a first side edge, and a second side edge, the top edge, bottom edge, and first and second side edges collectively forming a perimeter of the top panel of the inflatable mattress; and a sling sheet that is fixedly attached to the inflatable mattress about at least a portion of the perimeter of the top panel.

Aspect 20: The patient transfer device of Aspect 19, wherein the sling sheet further comprises a top panel portion and an elastic portion, the top panel portion having a first side and a second side, wherein the first side of the top panel portion is fixedly attached along the first side edge of the inflatable mattress and the second side of the top panel portion is fixedly attached along the second side edge of the inflatable mattress.

DETAILED DESCRIPTION OF THE EXEMPLARY EMBODIMENT(S)

The ensuing detailed description provides exemplary embodiment(s) only, and is not intended to limit the scope, applicability, or configuration of the herein disclosed invention. Rather, the ensuing detailed description of the exemplary embodiment(s) will provide those skilled in the art with an enabling description for implementing the exemplary embodiment(s) in accordance with the herein disclosed invention. It is understood that various changes may be made in the function and arrangement of elements of these embodiment(s) without departing from the spirit and scope of the invention, as set forth in the appended claims.

To aid in describing the invention, directional terms may be used in the specification and claims to describe portions of the present invention (e.g., upper, lower, left, right, etc.). These directional definitions are merely intended to assist in describing and claiming the invention and are not intended to limit the invention in any way. In addition, reference numerals that are introduced in the specification in association with a drawing figure may be repeated in one or more subsequent figures without additional description in the specification, in order to provide context for other features.

Inflatable patient transfer devices comprising an air mattress that is placed under a patient and periodically inflated when it is necessary to reposition or transport the patient are known in the art. For example, the prior art patient transfer device 1 of FIG. 1 is taught in U.S. Pat. No. 7,900,299, entitled Patient Transfer Device Having Inflatable Air Mattress, the entire contents of which are incorporated by reference as if set forth herein. This prior art patient transfer device 1 comprises a transfer mattress 2 comprising a plurality of fasteners 3 (for clarity, only one fastener is labeled in FIG. 1), a pair of longitudinally-extending side air chambers 5*a*,5*b*, a plurality of transverse air chambers (for clarity, only transverse air chamber 4*a* is labeled in FIG. 1), a seam 6 that separates the longitudinally-extending air chambers 5*a*,5*b* from the transverse air chambers, an inlet 7, and a gusset 9 located on either side of the transfer mattress 2 between the top panel and the lower panel thereof, which acts to maintain a relatively parallel orientation between the top and bottom panels of the mattress 2 when it is inflated (as shown in FIG. 1). An external supply hose 8 attached to an air-supply source is inserted into the inlet 7 and used to inflate the transfer mattress 2. In this prior art device 1, accessories may be removably attached to one or more of the fasteners 3. An accessory may be, for example, a carrying strap, belt, or handle.

Referring now generally to FIGS. 2-17, an embodiment of a patient transfer device 10 having an inflatable transfer mattress 12 and a fixedly-attached sling sheet 44 in accordance with the present invention will now be described in detail. In FIGS. 2-6, the sling sheet 44 is omitted from view for ease of illustrating the other parts of the device 10.

Figure 3:
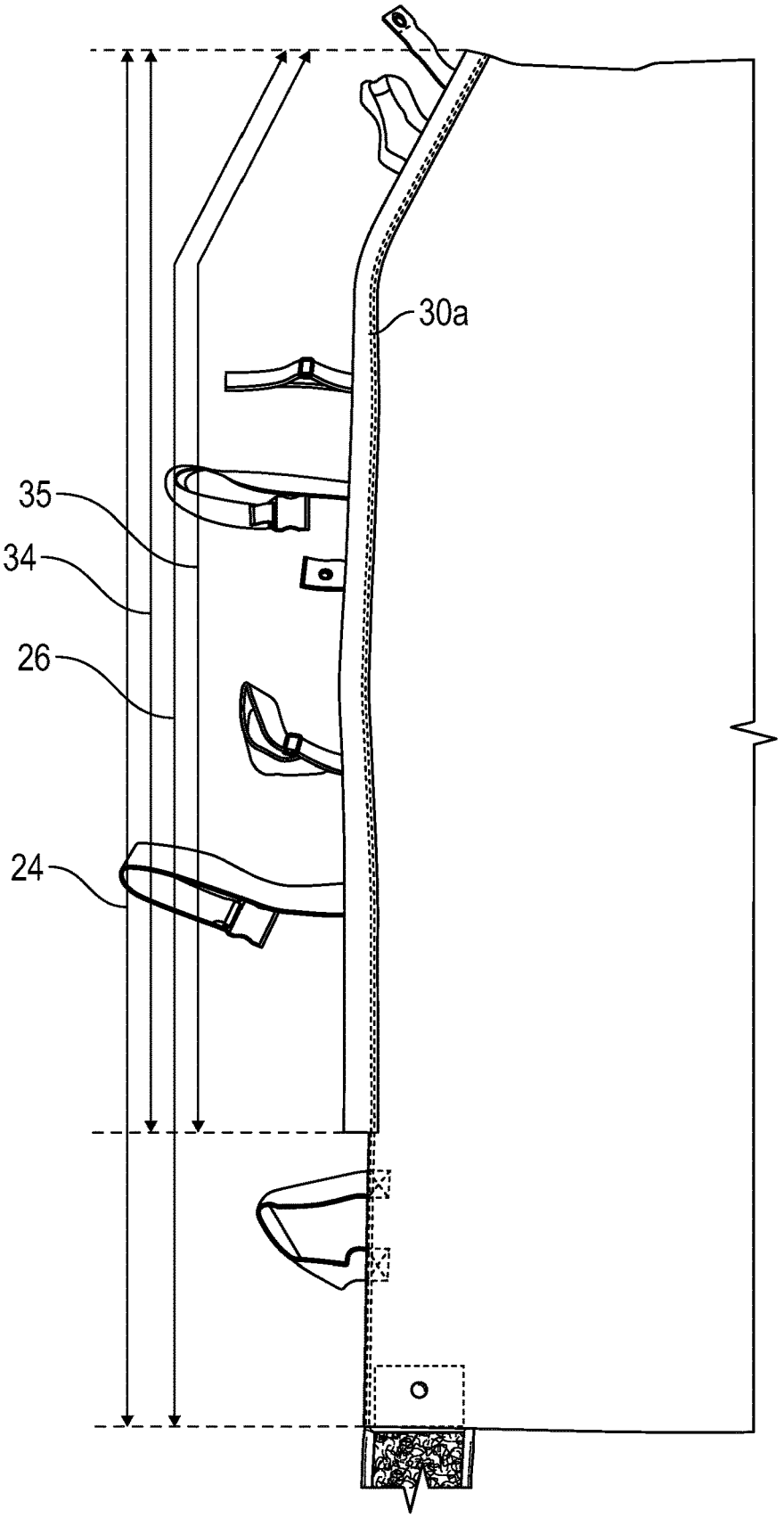
FIG. 3 is a partial front, elevated perspective view thereof.

The device 10 has an inlet 11 (see FIG. 4) into which an external supply hose (not shown) that is attached to an air-supply source can be inserted in order to inflate the mattress 12. The mattress 12 has a top panel 14, a bottom panel 15 (see FIG. 16), a pair of sides 17,19, and a pair of gussets (only one gusset 42 is shown in the figures; see FIG. 6). It should be understood that the two gussets are identical other than being mirror images; accordingly, only gusset 42 will be discussed in detail below. The top panel 14 of the mattress 12 has a top edge 20 that corresponds with a head end 16 of the mattress 12, a bottom edge 21 that corresponds with a foot end 18 of the mattress 12, and a pair of side edges 22,23. The edges 20-23 collectively form a perimeter 13 of the top panel 14 of the mattress 12. The gusset 42 is located between the top panel 14 and the bottom panel 15 along a portion of each side 17,19 of the mattress 12. An upper edge seam 37*a* runs along the side edge 22 and an upper edge seam 37*b* (see FIG. 7) runs along the side edge 23, and these upper edge seams 37*a*,37*b* connect together the top panel 14 and bottom panel 15 (or the top panel 14 and gusset 42). As shown in FIG. 3, the mattress 12 has a longitudinal length 24 that is measured along a single linear axis corresponding with either of the sides edges 22,23, and a linear length 26 that is measured directly along either of the side edges 22,23 between the top edge 20 and the bottom edge 21. The top panel 14 of the mattress 12 has a transverse width 28 that is measured between a pair of reinforcement strips 30*a*,30*b*, which are described below in further detail.

One novel feature of the present invention is the addition of reinforcement strips 30*a*,30*b* to the mattress 12 along the upper edge seams 37*a*,37*b*. Reinforcement strip 30*a* is fixedly attached—e.g., sewn—to side edge 22 along upper edge seam 37*a*, and reinforcement strip 30*b* is fixedly attached—e.g., sewn—to side edge 23 via upper edge seam 37*b*. It should be understood that reinforcement strips 30*a*, 30*b* are identical to each other and that upper edge seams 37*a*,37*b* are identical to each other, other than being respective mirror-images of each other. Therefore, for purposes of this disclosure, only reinforcement strip 30*a* and upper edge seam 37*a* will be discussed hereinafter, it being understood that all descriptions and discussions relating to reinforcement strip 30*a* are equally applicable to reinforcement strip 30*b* and that all descriptions and discussions relating to upper edge seam 37*a* are equally applicable to upper edge seam 37*b*. In this embodiment, reinforcement strip 30*a* has a top end 32, a bottom end 33, a longitudinal length 34 that is measured along a single linear axis corresponding with the side edge 22, and a linear length 35 that is measured directly along the side edge 22. The reinforcement strip 30*a* is attached along the upper edge seam 37*a* such that the reinforcement strip 30*a* extends outside of (i.e., exterior to) the perimeter 13 of the top panel 14 of the mattress 12.

In some embodiments, the longitudinal length 34 of the reinforcement strip is at least 50% of the longitudinal length 24 of the mattress 12. In alternate embodiments, the longitudinal length 34 of the reinforcement strip is at least 65% of the longitudinal length 24 of the mattress 12. In still other embodiments, the longitudinal length 34 of the reinforcement strip is at least 80% of the longitudinal length 24 of the mattress 12.

Figure 4:
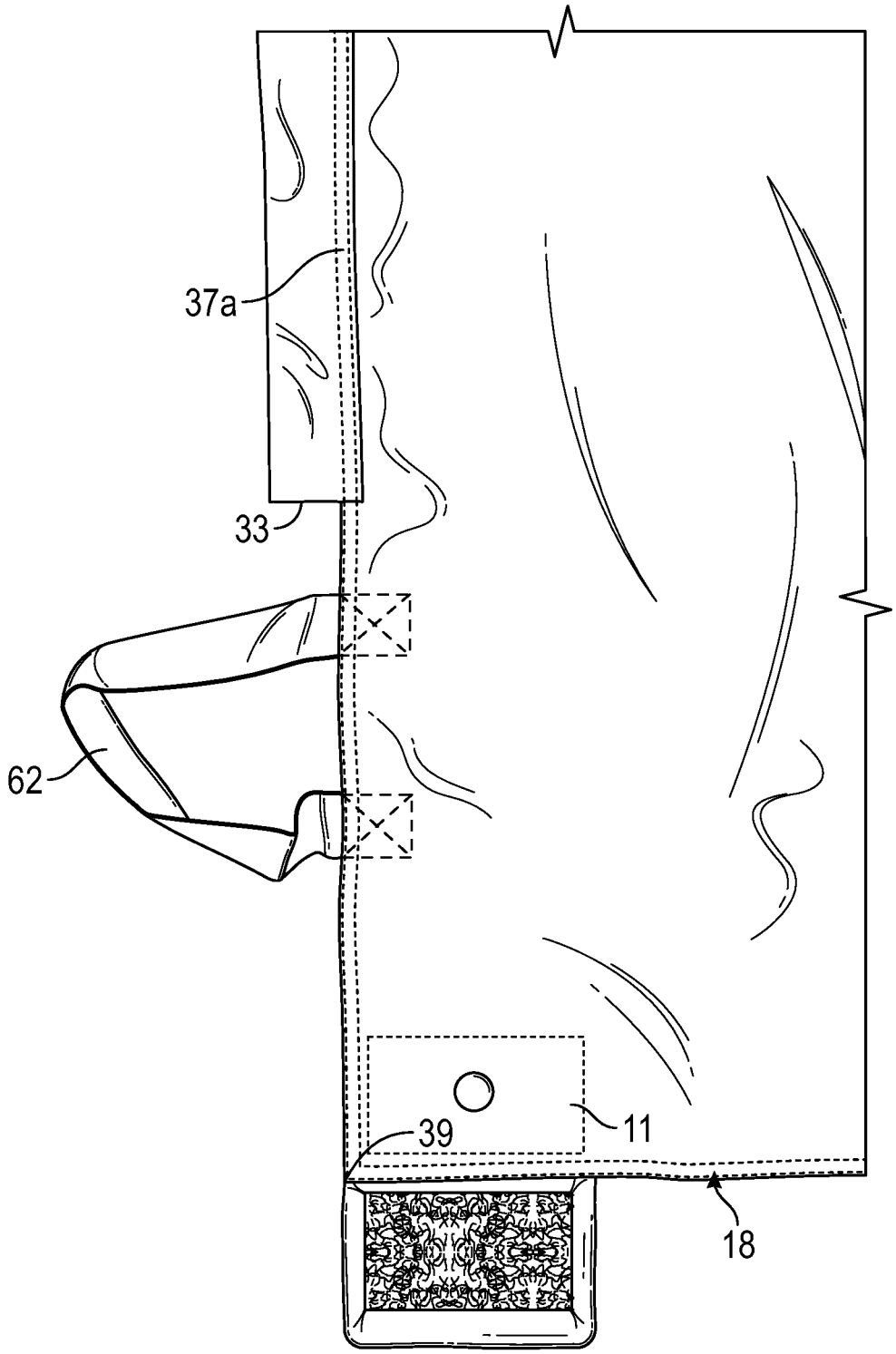
FIG. 4 is a partial close-up view thereof.
Figure 5:
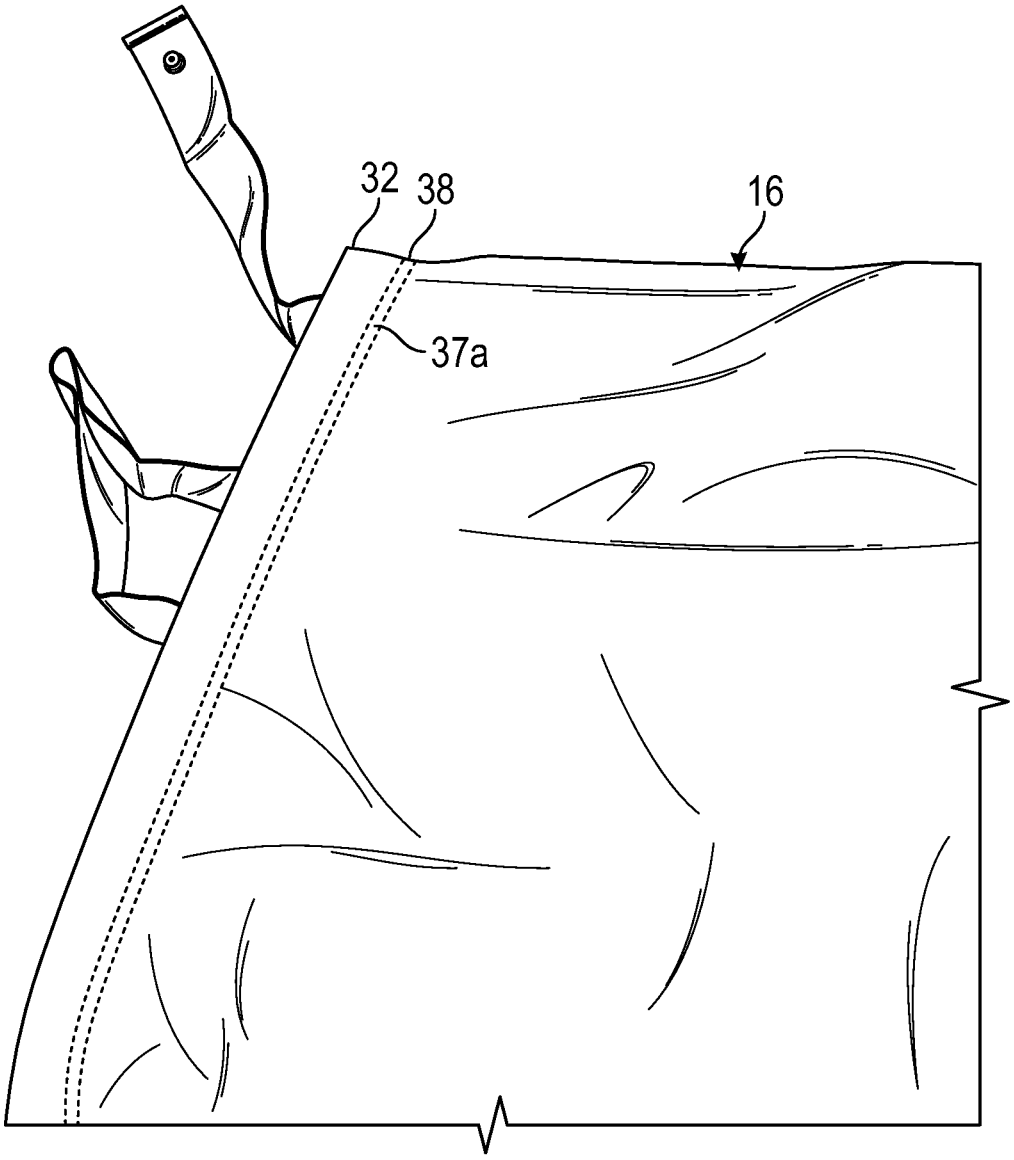
FIG. 5 is a partial close-up view thereof.

The upper edge seam 37*a* has a top end 38 and a bottom end 39. In this embodiment, as best shown in FIG. 5, the location of the top end 38 of the upper edge seam 37*a* corresponds with the location of the top end 32 of the reinforcement strip 30*a*. As best seen in FIG. 4, in this embodiment the bottom end 33 of the reinforcement strip 30*a* terminates short of the bottom end 39 of the upper edge seam 37*a*, which extends all the way down the side edge 22 to where it joins with the bottom edge 21 of the top panel 14 of the mattress 12.

Figure 6:
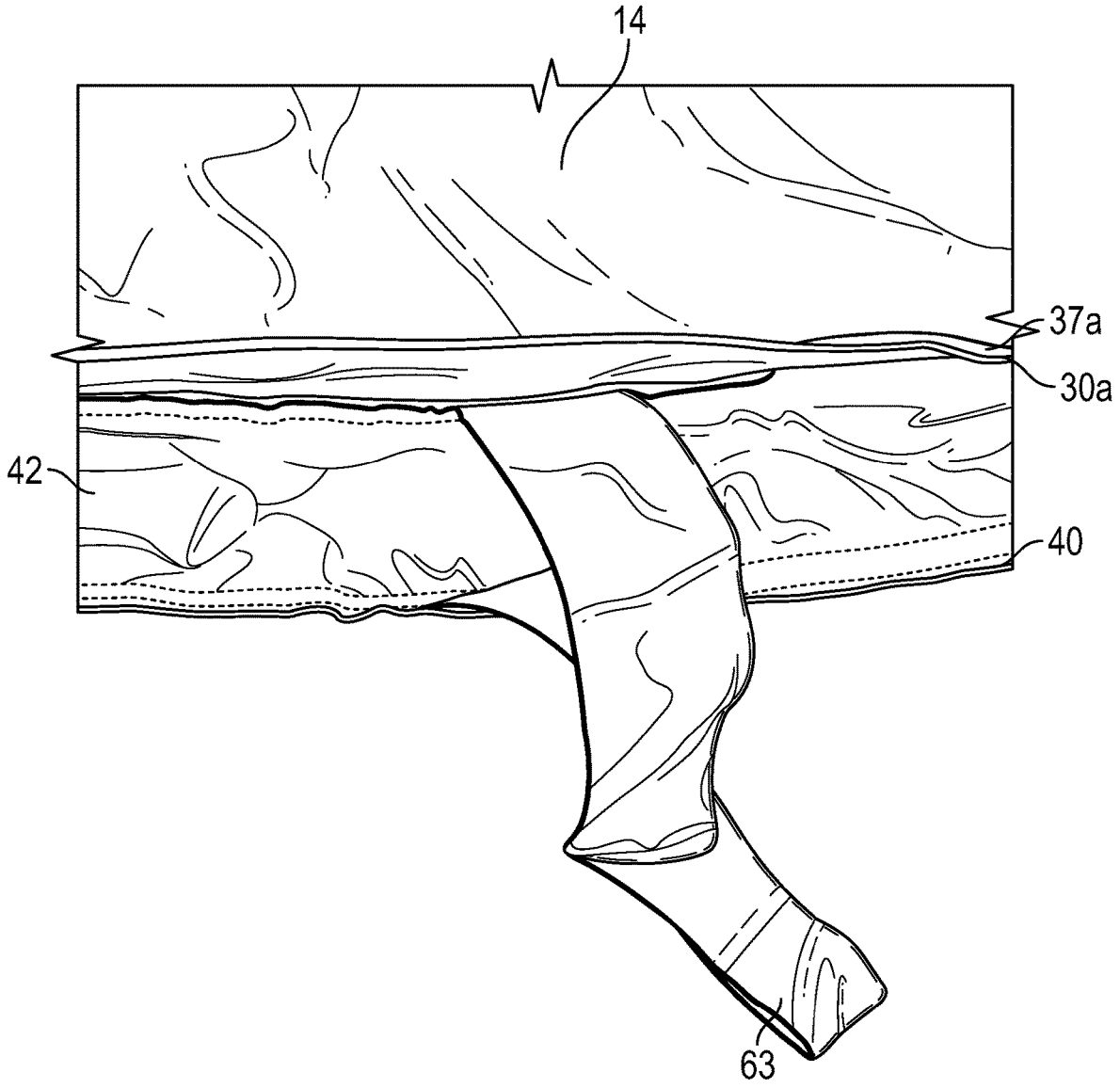
FIG. 6 is a partial side view thereof.
Figure 7:
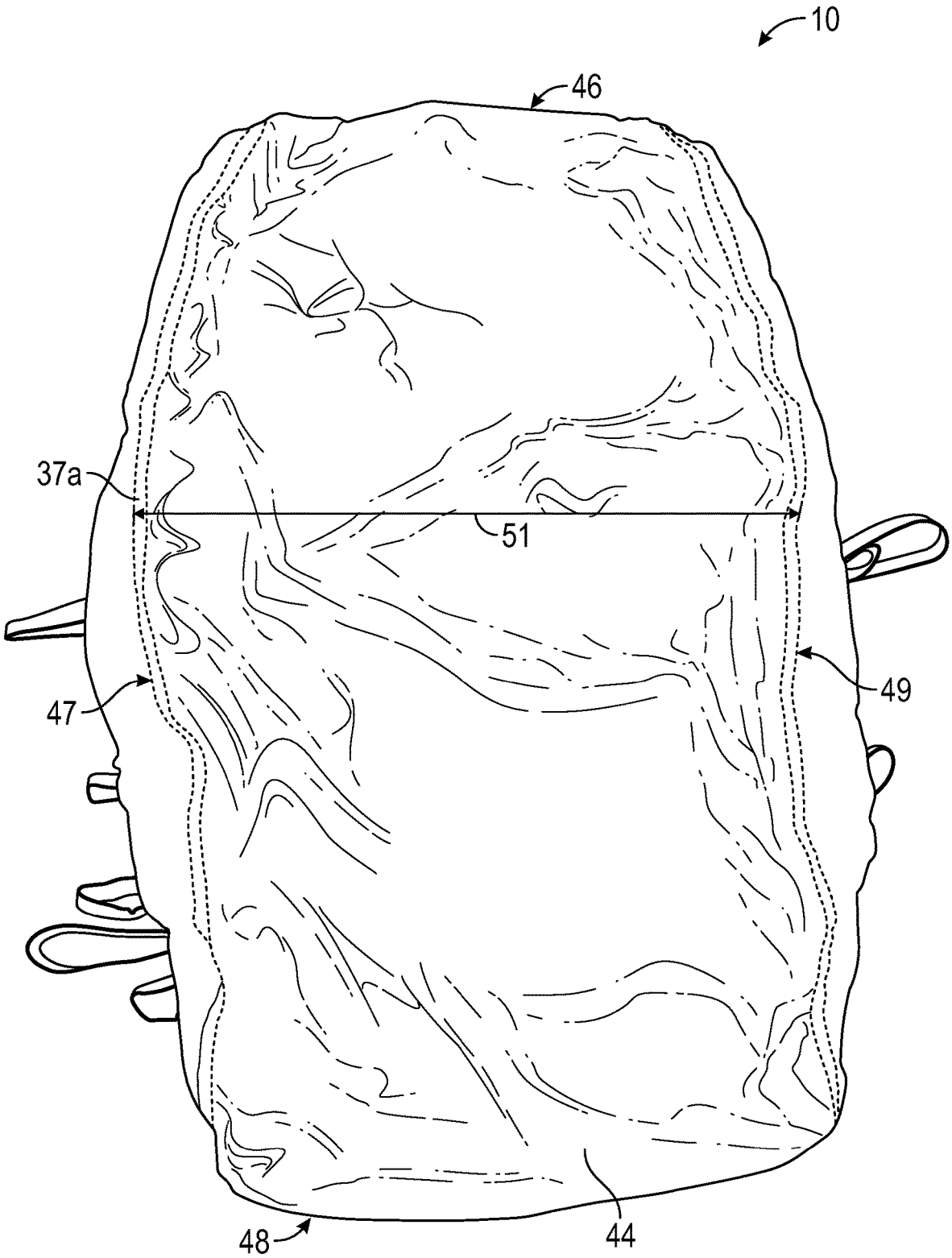
FIG. 7 is a front, elevated, perspective view of the patient transfer device having an inflatable mattress and a fixedly-attached sling sheet in accordance with the present invention, with the sling sheet shown.
Figure 8:
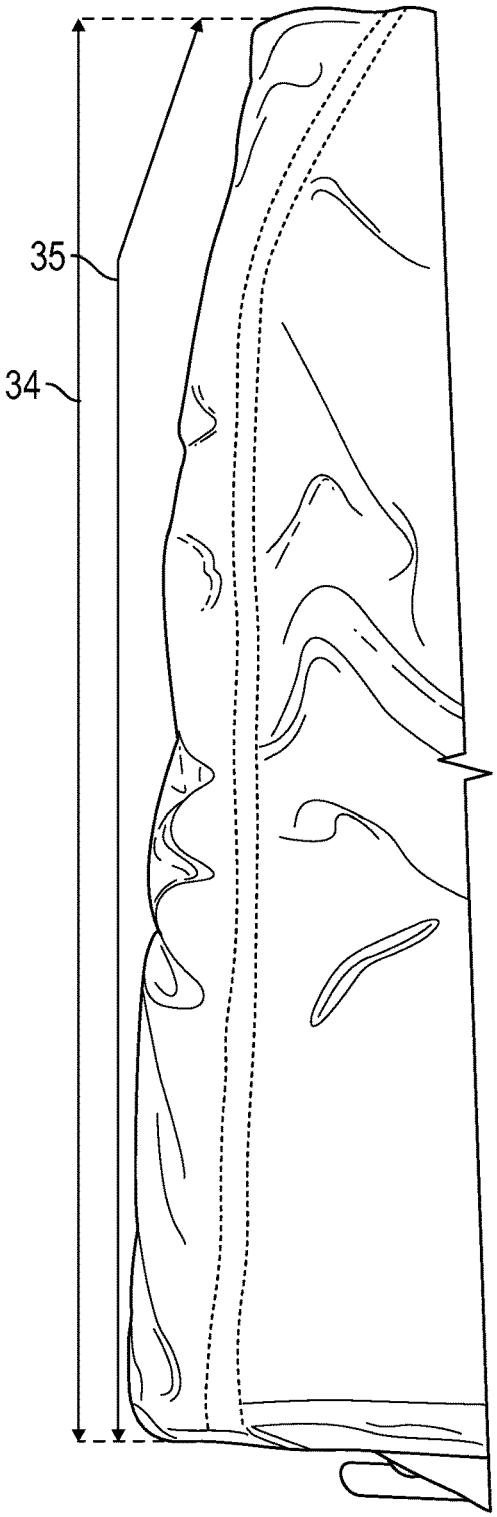
FIG. 8 is a partial front, elevated perspective view thereof.
Figure 9:
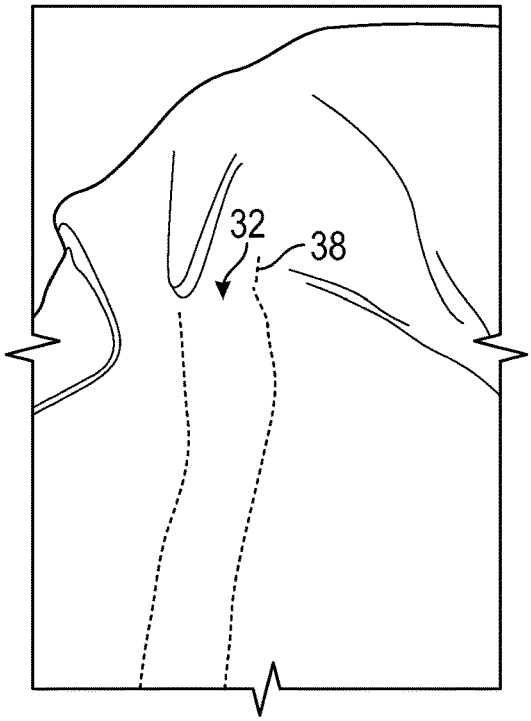
FIG. 9 is a partial close-up view thereof.
Figure 10:
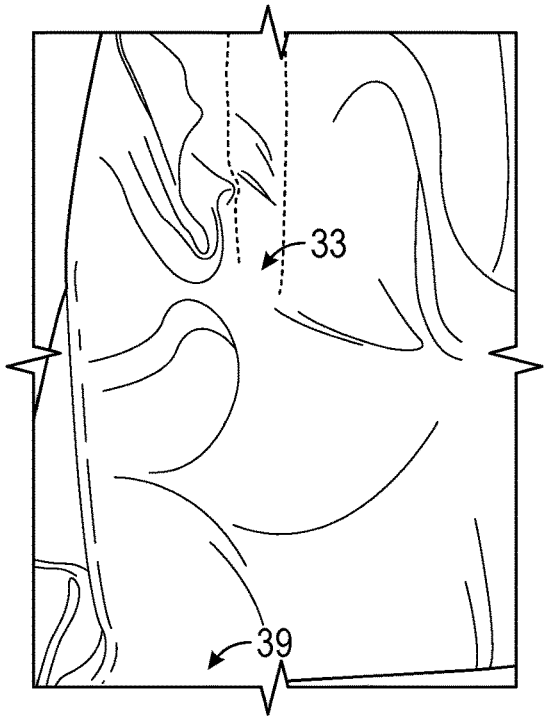
FIG. 10 is a partial close-up view thereof.

As noted above, the gusset 42 connects the top panel 14 to the bottom panel 15 along a portion of each of the sides 17,19 of the mattress 12. In this embodiment, the location of the bottom end of the gusset 42 corresponds approximately with the bottom end 33 of the reinforcement strip 30*a*, and the location of the top end of the gusset 42 terminates short of the top end 32 of the reinforcement strip 30*a*. Therefore, in this embodiment, the lengths 34,35 of the reinforcement strip 30*a* are greater than the corresponding longitudinal and linear lengths (not labeled) of the gusset 42. As shown in FIG. 6, the gusset 42 that corresponds with side 17 of the mattress 12 is attached to the top panel 14 via the upper edge seam 37*a* (which is also attached to the reinforcement strip 30*a*), and the gusset 42 is also connected to the bottom panel 15 via a lower edge seam 40. As noted above, the gusset (not shown) that corresponds with side 19 of the mattress is functionally identical to gusset 42.

Figure 11:
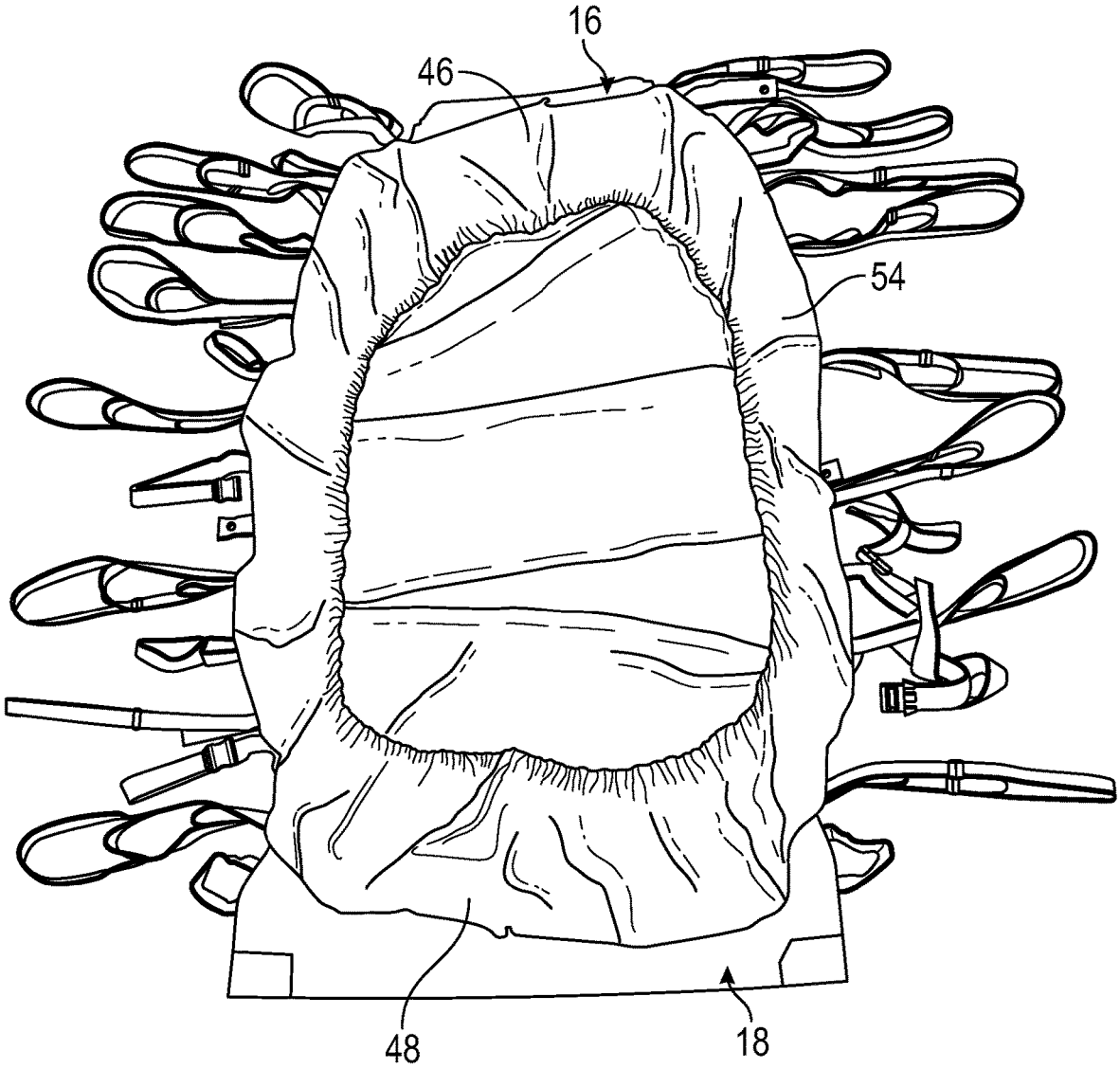
FIG. 11 is a front, elevated perspective view of the patient transfer device of FIG. 7, with the elastic portion of the sling sheet thereof turned inside-out.
Figure 12:
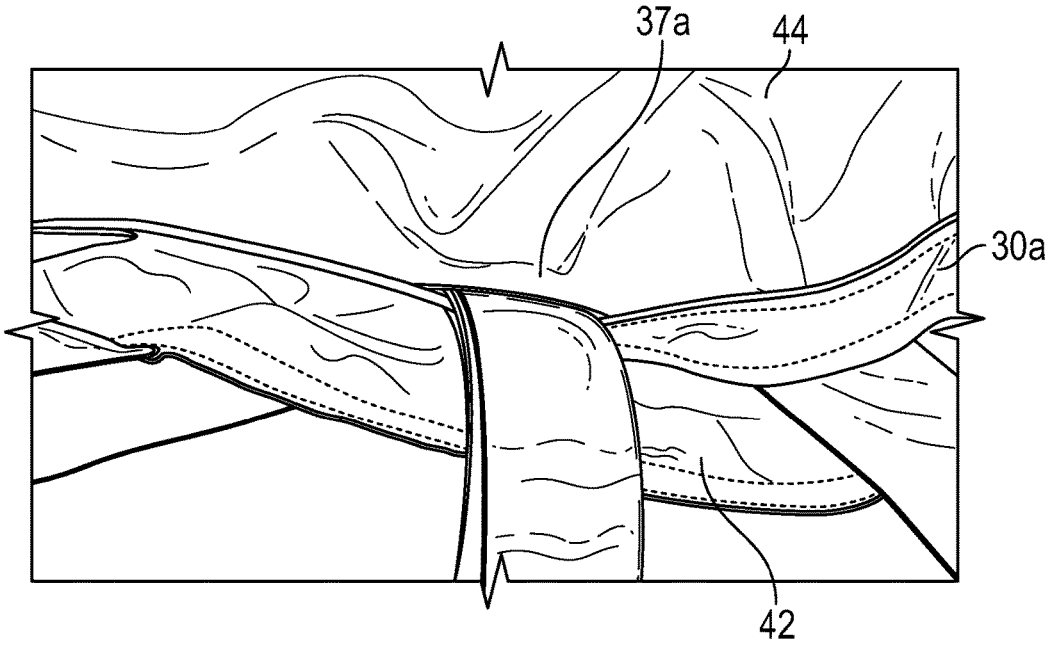
FIGS. 12 and 13 are partial side views thereof.
Figure 13:
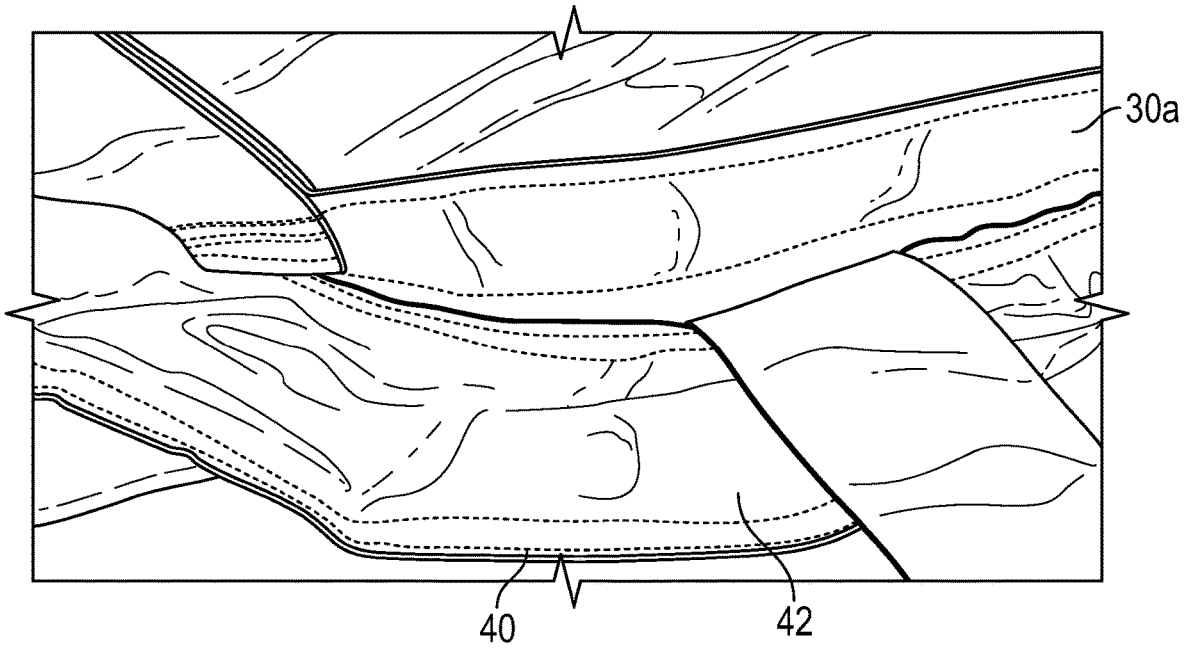

FIGS. 7-17 show various views of the device 10 of the present invention including the fixedly-attached sling sheet 44. The sling sheet 44 has a head end 46 that corresponds with the head end 16 of the mattress 12, a foot end 48 that corresponds with the foot end 18 of the mattress 12, a top panel portion 50 which is attached along the upper edge seams 37*a*,37*b* to the respective reinforcement strips 30*a*, 30*b*, and an elastic (fitted) portion 54 (see FIG. 11) located around the perimeter of the top panel portion 50 for attaching the sling sheet 44 of the device 10 to a bed mattress or hospital bed mattress. The top panel portion 50 comprises a first side 47 and a second side 49. In FIG. 11, the elastic portion 54 is shown turned inside out so that it partially covers the top panel portion 50, and the various straps, handles, and belts of the device 10 are clearly visible, including but not limited to patient support buckles 60,61, which are used to support a patient on the device 10, and support straps 62,63,64 (see FIGS. 4, 6, 16, and 17), which are used to support the weight of the device 10 and the patient as the patient is being moved. The support straps 62,63,64 may also be used to support the device 10 from a sling or lift mechanism.

The top panel portion 50 of the sling sheet 44 has a transverse width 51 that is measured between the upper edge seams 37*a*,37*b*. An additional novel feature of the present invention is a method by which the top panel 14 of the mattress 12 and the top panel portion 50 of the sling sheet 44 are brought together, indexed (i.e., brought into tension) along their respective transverse widths 28,51 at the same time in order to remove any folds or wrinkles that are present in the respective materials, and then the top panel 14 and the top panel portion 50 are fixedly attached together via reinforcement strips 30*a*,30*b* in order to assemble the device 10. In this way, the patient transfer device 10 is constructed having the inflatable mattress 12 and the sling sheet 44 fixedly attached together, without any wrinkles or folds being able to form in the sling sheet 44 as the inflatable mattress 12 is inflated and deflated. In this embodiment the top panel 14 of the mattress 12 and the top panel portion 50 of the sling sheet 44 are fixedly attached together via sewn threads. In alternate embodiments, the top panel 14 and top panel portion 50 may be fixedly attached together via a suitable adhesive, stapling, riveting, or other suitable means of fixedly attaching two items together.

Figure 14:
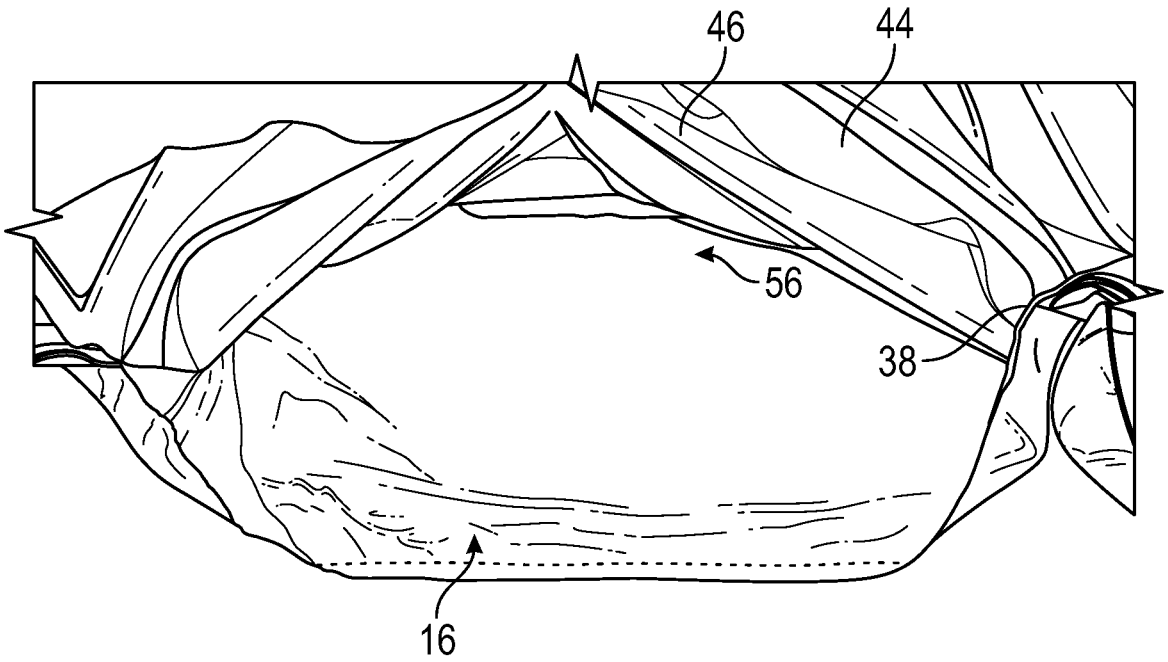
FIG. 14 is a partial top view thereof.
Figure 15:
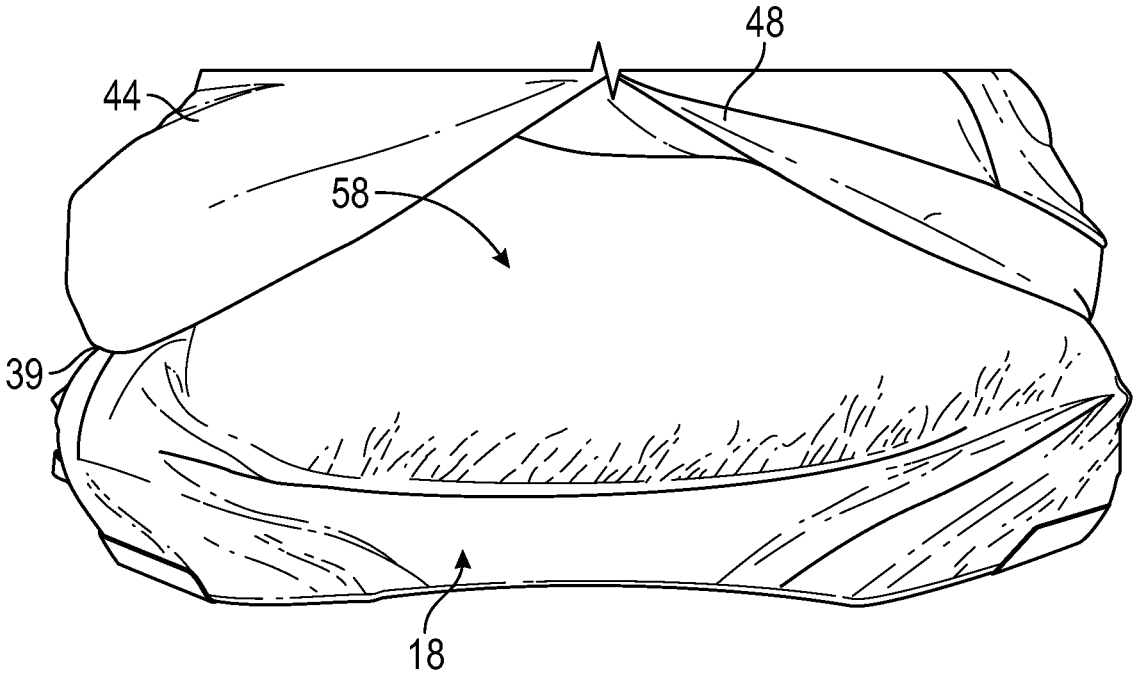
FIG. 15 is a partial bottom view thereof.

As best seen in FIG. 14, in this embodiment, because the sling sheet 44 is not attached to the mattress 12 along the top edge 20 of the top panel 14 of the mattress 12, a head end opening 56 is present between the sling sheet 44 and the mattress 12. Likewise, as best seen in FIG. 15, because the sling sheet 44 is not attached to the mattress 12 along the bottom edge 21 of the top panel 14 of the mattress 12, a foot end opening 58 is present between the sling sheet 44 and the mattress 12. In alternate embodiments, the sling sheet 44 could be fixedly or removably attached to the mattress 12 along the top edge 20 and/or bottom edge 21 of the top panel 14 of the mattress.

Figure 16:
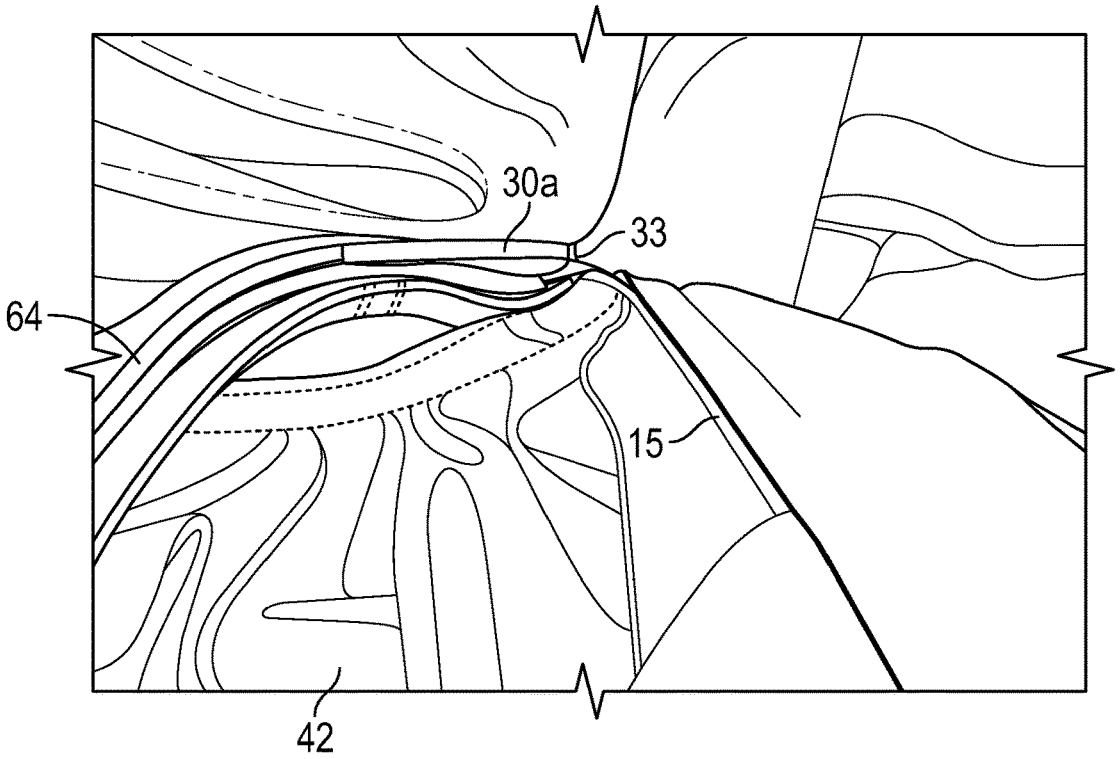
FIGS. 16 and 17 are close-up views of the joining of the sling sheet to the inflatable mattress of the present invention.
Figure 17:
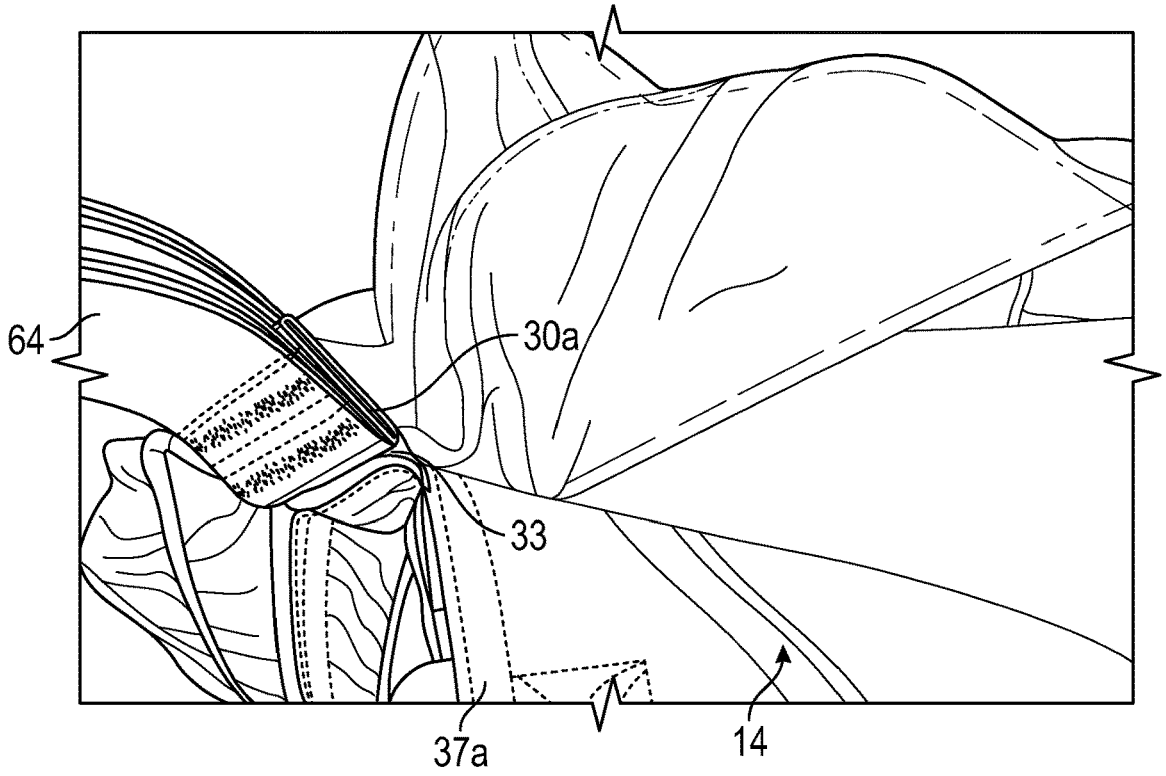

As best seen in FIGS. 16 and 17, in this embodiment the reinforcement strip 30*a* is sewn above the top panel 14 of the mattress 12, in other words directly between the top panel 14 and the sling sheet 44. In alternate embodiments, the reinforcement strip 30*a* could be sewn between the top edge of the gusset 42 and the top panel 14 of the mattress. An additional novel feature of the present invention is that the accessories, e.g., the carrying straps, belts, and handles, are fixedly attached (e.g., sewn) to the device 10 via the reinforcement strips 30*a*,30*b*. In alternate embodiments according to the present invention, the accessories could be removably attached to the device 10, for example via zippers, snap rivets, or other types of suitable fasteners.

Although exemplary implementation(s) of the herein described device(s) and/or method(s) have been described in detail above, those skilled in the art will readily appreciate that many additional modifications are possible in the exemplary embodiment(s) without materially departing from the novel teachings and advantages of the herein described device(s) and/or method(s). Accordingly, these and all such modifications are intended to be included within the scope of the herein described device(s) and/or method(s). The herein described device(s) and/or method(s) may be better defined by the following exemplary claims.

What is claimed is:

1. A patient transfer device comprising:

an inflatable mattress having a top panel, the top panel having a top edge, a bottom edge, a first side edge, and a second side edge, the top edge, bottom edge, and first and second side edges collectively forming a perimeter of the top panel of the inflatable mattress;

a sling sheet having a top panel portion, the top panel portion having a first side and a second side;

a first reinforcement strip that is fixedly attached to the first side edge of the top panel of the inflatable mattress and to the first side of the top panel portion of the sling sheet, the first reinforcement strip extending along the first side edge from the top edge toward the bottom edge and terminating prior to reaching the bottom edge;

a second reinforcement strip that is fixedly attached to the second side edge of the top panel of the inflatable mattress and to the second side of the top panel portion of the sling sheet, the second reinforcement strip extending along the second side edge from the top edge toward the bottom edge and terminating prior to reaching the bottom edge;

an air inlet formed in the inflatable mattress at a foot portion of the inflatable mattress disposed proximate the bottom edge and extending across a width of the inflatable mattress from the first side edge to the second side edge, the foot portion including regions of the first and second side edges disposed respectively between the end of each of the first and second reinforcement strips and the bottom edge; and a first foot portion carrying strap disposed in the foot portion and attached to the first side edge and the top panel portion, wherein the top panel of the inflatable mattress and the top panel portion of the sling sheet are indexed between the first and second reinforcement strips.

2. The patient transfer device of claim 1, wherein the first reinforcement strip and the second reinforcement strip are fixedly attached between the top panel of the inflatable mattress and the top panel portion of the sling sheet.

3. The patient transfer device of claim 1, wherein the first reinforcement strip and second reinforcement strip are fixedly attached to the inflatable mattress and to the sling sheet via sewn threads.

4. The patient transfer device of claim 1, wherein at least a portion of the first reinforcement strip and at least a portion of the second reinforcement strip extend outside of the perimeter of the top panel of the inflatable mattress.

5. The patient transfer device of claim 1, wherein the inflatable mattress has a longitudinal length measured along the first side edge of the top panel between the top edge and the bottom edge thereof, the first reinforcement strip has a top end, a bottom end disposed near the foot portion, and a longitudinal length measured along the first side edge of the top panel between the top end and the bottom end of the first reinforcement strip, and the longitudinal length of the first reinforcement strip is at least 50% of the longitudinal length of the inflatable mattress.

6. The patient transfer device of claim 5, wherein the longitudinal length of the first reinforcement strip is at least 80% of the longitudinal length of the inflatable mattress.

7. The patient transfer device of claim 5, wherein at least a portion of the first reinforcement strip extends outside of the perimeter of the top panel of the inflatable mattress.

8. The patient transfer device of claim 1, further comprising a first carrying strap that is fixedly attached to the first reinforcement strip and a second carrying strap that is fixedly attached to the second reinforcement strip.

9. A method of constructing a patient transfer device, the patient transfer device comprising an inflatable mattress having a width and a length extending from a head end to a foot end, and a sling sheet having a width and a length extending from a head end to a foot end, the method comprising:

placing the sling sheet adjacent to the inflatable mattress;

applying a sufficient amount of tension along the width of the inflatable mattress while it is uninflated to remove all folds and wrinkles from the width of the inflatable mattress while applying a sufficient amount of tension along the width of the sling sheet to remove all folds and wrinkles from the width of the sling sheet;

fixedly attaching together the inflatable mattress and the sling sheet so that the width of the inflatable mattress and the width of the sling sheet are indexed together;

fixedly attaching at least one reinforcement strip between the inflatable mattress and the sling sheet along at least one side portion of the inflatable mattress and the sling sheet, the at least one reinforcement strip extending from the head end of the inflatable mattress toward the foot end of the inflatable mattress and terminating prior to the foot end of the inflatable mattress; and fixedly attaching a first carrying strap to the inflatable mattress at the least one side portion between the at least one reinforcement strip and the foot end of the inflatable mattress without attaching to the at least one reinforcement strip.

10. The method of claim 9, further comprising fixedly attaching at least one carrying strap to the at least one reinforcement strip.

11. The method of claim 9, wherein the step of fixedly attaching together the inflatable mattress and the sling sheet further comprises sewing the inflatable mattress and the sling sheet together.

12. A patient transfer device comprising:

an inflatable mattress having a top panel, a bottom panel, a top end, a bottom end, a first side, a second side, a first gusset attached between the top panel and the bottom panel along at least a portion of the first side, and a second gusset attached between the top panel and the bottom panel along at least a portion of the second side, the top panel having a first side edge corresponding with the first side of the inflatable mattress, a second side edge corresponding with the second side of the inflatable mattress, a top edge corresponding with the top end of the inflatable mattress, and a bottom edge corresponding with the bottom end of the inflatable mattress;

a sling sheet having a top panel portion, the top panel portion having a first side and a second side;

a first reinforcement strip that is fixedly attached to the first side edge of the top panel of the inflatable mattress and the first side of the top panel portion of the sling sheet, the first reinforcement strip extending along the first side edge from the top edge toward the bottom edge and terminating prior to reaching the bottom edge;

a second reinforcement strip that is fixedly attached to the second side edge of the top panel of the inflatable mattress and the second side of the top panel portion of the sling sheet, the second reinforcement strip extending along the second side edge from the top edge toward the bottom edge and terminating prior to reaching the bottom edge;

a first carrying strap that is fixedly attached to the first reinforcement strip; and a second carrying strap that is fixedly attached to the second reinforcement strip.

13. The patient transfer device of claim 12, wherein the first gusset has a longitudinal length measured along the first side of the inflatable mattress, the second gusset has a longitudinal length measured along the second side of the inflatable mattress, the first reinforcement strip has a top end, a bottom end, and a longitudinal length measured along the first side edge of the top panel between the top end and the bottom end of the first reinforcement strip, the second reinforcement strip has a top end, a bottom end, and a longitudinal length measured along the second side edge of the top panel between the top end and the bottom end of the second reinforcement strip, wherein the longitudinal length of the first reinforcement strip is greater than the longitudinal length of the first gusset and the longitudinal length of the second reinforcement strip is greater than the longitudinal length of the second gusset.

14. The patient transfer device of claim 12, wherein the top panel of the inflatable mattress further comprises a top edge and a bottom edge, the top edge, bottom edge, and first and second side edges of the top panel collectively forming a perimeter of the top panel, wherein at least a portion of the first reinforcement strip and at least a portion of the second reinforcement strip extend outside of the perimeter of the top panel.

15. The patient transfer device of claim 12, wherein the first reinforcement strip and the second reinforcement strip are fixedly attached between the top panel of the inflatable mattress and the top panel portion of the sling sheet.

16. The patient transfer device of claim 12, wherein the first reinforcement strip and second reinforcement strip are fixedly attached to the inflatable mattress and to the sling sheet via sewn threads.

17. The patient transfer device of claim 12, wherein the top panel of the inflatable mattress further comprises a top edge and a bottom edge, the top edge, bottom edge, and first and second side edges of the top panel of the inflatable mattress collectively forming a perimeter of the top panel, wherein at least a portion of the first reinforcement strip and at least a portion of the second reinforcement strip extend outside of the perimeter of the top panel of the inflatable mattress.

18. The patient transfer device of claim 12, wherein the inflatable mattress has a longitudinal length measured along the first side edge of the top panel between a top edge and a bottom edge of the top panel, the first reinforcement strip has a top end, a bottom end, and a longitudinal length measured along the first side edge of the top panel between the top end and the bottom end of the first reinforcement strip, and the longitudinal length of the first reinforcement strip is at least 50% of the longitudinal length of the inflatable mattress.

19. The patient transfer device of claim 18, wherein the longitudinal length of the first reinforcement strip is at least 80% of the longitudinal length of the inflatable mattress.

* * * * *